US007363124B1

(12) United States Patent
Duarte

(10) Patent No.: US 7,363,124 B1
(45) Date of Patent: Apr. 22, 2008

(54) DISPERSE, AGGREGATE AND DISPERSE (DAD) CONTROL STRATEGY FOR MULTIPLE AUTONOMOUS SYSTEMS TO OPTIMIZE RANDOM SEARCH

(75) Inventor: Christiane N. Duarte, Fall River, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1826 days.

(21) Appl. No.: 09/226,623

(22) Filed: Dec. 21, 1998

(51) Int. Cl.
*G06F 7/70* (2006.01)
*G06G 7/64* (2006.01)

(52) U.S. Cl. ..... 701/23; 701/210; 701/200; 701/26; 701/214; 89/1.13

(58) Field of Classification Search ..... 701/23, 701/200, 210, 214, 26, 25; 89/1.13
See application file for complete search history.

(56) References Cited

U.S. PATENT DOCUMENTS

| | | | | |
|---|---|---|---|---|
| 5,164,910 | A * | 11/1992 | Lawson et al. | 235/411 |
| 5,321,614 | A * | 6/1994 | Ashworth | 701/26 |
| 5,329,450 | A * | 7/1994 | Onishi | 701/24 |
| 5,568,030 | A * | 10/1996 | Nishikawa et al. | 318/587 |
| 5,652,489 | A * | 7/1997 | Kawakami | 318/587 |
| 5,911,773 | A * | 6/1999 | Mutsuga et al. | 701/200 |
| 6,078,865 | A * | 6/2000 | Koyanagi | 701/211 |

* cited by examiner

*Primary Examiner*—Gregory C Issing
(74) *Attorney, Agent, or Firm*—James M. Kasischke; Michael P. Stanley; Jean-Paul A. Nasser

(57) ABSTRACT

A method for conducting a search of an area for targets by a number of vehicles. First each of the vehicles randomly disperses from the other vehicles. Then during an aggregate phase, each vehicle responds in a predesignated way to an encounter with one of the other vehicles. A number of specific search strategies may be followed which tend to direct the search in a particular designated direction or allow a successful searching vehicle to set the direction of the search. This method results in improved performance in conducting searches by robots or other vehicles.

19 Claims, 2 Drawing Sheets

DISPERSE, AGGREGATE AND DISPERSE (DAD) CONTROL STRATEGY FOR MULTIPLE AUTONOMOUS SYSTEMS TO OPTIMIZE RANDOM SEARCH

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to travel control methods and in particular to such methods which are used to control search vehicles.

(2) Brief Description of the Prior Art

When searching an area for an object such as a mine, it is often desirable to search an area using expendable units. These units should have a relatively low cost, but they should also be capable of searching an area in an efficient fashion.

One way of searching an area is by an ordered search algorithm such as a grid. Grids are not readily adaptable to rough terrain, and the party positioning the search object can optimize placement of search objects to reduce grid efficiency.

Another method of searching an area is by random dispersal. Random dispersal requires little control and accommodates any terrain type. The problem with random dispersal is that it is inefficient. Some areas go unsearched while other areas are subjected to multiple searches.

Various methods and apparatus are disclosed in the prior art for controlling robotic vehicles.

U.S. Pat. No. 5,321,614 to Ashworth, for example, discloses a control apparatus and method for autonomous vehicles. Obstacle sensors onboard each vehicle produce signals associated with obstacles used for navigation.

U.S. Pat. No. 5,329,450 to Onishi discloses a control method for multiple robots in which a central control station distributes remaining tasks to robots having no task.

U.S. Pat. No. 5,367,456 to Summerville et al. discloses a control system for automatically guided vehicles. A stationary control computer schedules the activities of individual robots.

U.S. Pat. No. 5,568,030 to Nishikawa et al. discloses a travel control method for a plurality of robots. Each destination route is searched for availability prior to being used to control a robot's travel path.

U.S. Pat. No. 5,652,489 to Kawakami discloses a mobile robot control system in which each robot emits a signal. The signal is used to stop movement of other robots about to traverse the same route.

None of these methods provides a control method using a decentralized method of controlling low cost robots.

SUMMARY OF THE INVENTION

The object of this invention is to define a control strategy framework that will improve the performance of multiple robots when searching an area. This framework builds on a random search strategy by introducing two kinds of phases: a disperse phase and an aggregate phase. During the disperse phase, the vehicles perform a random search, which will result in the group dispersing over the search area. During the aggregate phase, the vehicles will continue to search, but will also communicate with neighbors when they come into communication range of each other. This is referred to as an "encounter". During an encounter, two vehicles exchange information and adjust their headings based on the current encounter strategy. The combination of these phases results in a group of robots performing a random search enhanced by intra-group communication that will provide better group cohesion and a more efficient search. The disperse, aggregate, and disperse combination is referred to as the DAD-Control Strategy. The DAD-Control Strategy framework allows variations in several fundamental ways: the duration of each phase, combination of the phases, (e.g., DADAD), and the selection of encounter strategies during the aggregate phases.

The present invention comprises a method for conducting a search of an area for targets by a plurality of vehicles. First each vehicle disperses from the other vehicles. Then during the aggregate phase each of the vehicles responds in a predesignated way to an encounter with one of the other vehicles.

BRIEF DESCRIPTION OF THE DRAWINGS

Other objects, features and advantages of the present invention will become apparent upon reference to the following description of the preferred embodiments and to the drawing, wherein corresponding reference characters indicate corresponding parts in the drawing and wherein.

DETAILED DESCRIPTION OF THE PREFERRED EMBODIMENT

Figure 1:
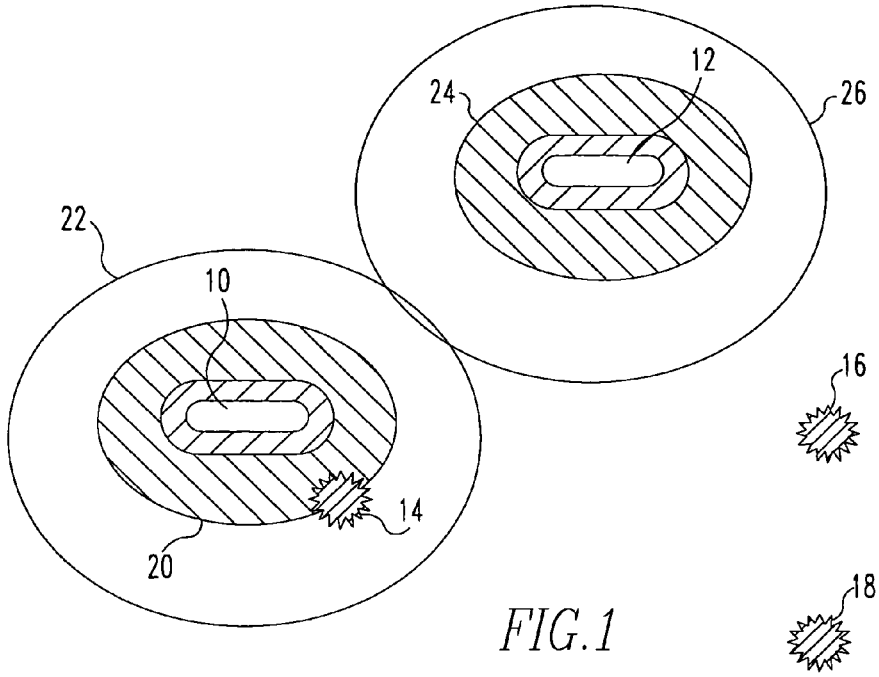
FIG. 1 is a schematic drawing illustrating an encounter between two vehicles and a detection of a target in a preferred embodiment of the method of the present invention.

The underlying philosophy in robot maneuvering logic is to keep the logic simple. A powerful and yet simple to implement control strategy for multiple vehicles searching as a group is a random search strategy. There is little to no dependency on neighbors in determining next position. Given enough time an area can be completely covered much in the way a gas will fill a volume. The robots in this simulation use random changes in heading and random number of steps forward. This allows the robot to wander in and out of an area. The goal is to improve the efficiency of this simple search scheme by allowing exchanges of information that will improve the efficiency of the next move decision logic of the robot. This establishes a minimal level of connectivity between group members. The connectivity is established when two members come into range, recognize each other and establish a communication link long enough to exchange a pre-determined packet of information. Once the information is transmitted, the connectivity is terminated.

The proposed control strategy is a combination of two types of maneuvering phases: a disperse phase and an aggregate phase. The natural side effect of a group of vehicles performing a random search is that the vehicles spread out or disperse over time. The disperse phase produces such an emergent behavior as each vehicle follows a random search with communication only present to avoid the other vehicles, and the group disperses over the search area. The aggregate phase maintains the random search maneuvering, but then introduces opportunities for two vehicles to exchange information through encounters. Information exchange is primarily focused on adjusting the heading of one or both vehicles based on the encounter strategy. Other information categories can be investigated along with new encounter strategies. By running a sequence of disperse, aggregate and disperse (DAD) phases, the overall performance should improve because the vehicles remain more concentrated or guided during the random search phases.

During the disperse phase, a random walk scheme is used. In this scheme, vehicles can randomly turn from −45 degrees to 45 degrees. Vehicles can also advance from 1 to 10 steps forward. The upper limit of the turn has been tested at ranges of ±45 degrees, ±90 degrees ±180 degrees. The value can be set according to the amount of dispersal and overlap for the particular application.

During the aggregate phase, vehicles also use the random walk scheme, but also communicate during encounters. An encounter occurs when vehicles are within a predetermined encounter distance to each other. This is defined as the variable encounter zone, which has a constant value of 70 (units of distance). The exchange of information is based on the current encounter strategy.

When two vehicles are within the encounter zone distance apart, the vehicles exchange information that impacts the heading of one or both vehicles. An encounter threshold variable is set that establishes to some degree the frequency with which vehicles change heading based on an encounter with the same vehicle. Sensitivity tests were made varying the encounter threshold variable by values of 0, 5 and 10. This signifies that two vehicles will not re-encounter for the number of simulation cycles specified by the encounter threshold after the initial encounter even if they remain in the encounter zone.

There are different strategies that were tested when two vehicles encounter one another. These strategies were motivated by operational requirements in littoral waters and studies of animal behavior in a foraging scenario.

Referring to FIG. 1, a first vehicle 10 and a second vehicle 12 are illustrated. Also illustrated are three targets 14, 16 and 18. The first vehicle 10 has a detection range 20 and an encounter zone 22. The second vehicle 12 has a detection range 24 and an encounter zone 26. A detection occurs when one of the vehicles, such as vehicle 10 approaches one of the targets such as target 14 within the vehicle's detection range such as detection range 20. An encounter occurs when two vehicles such as first vehicle 10 and second vehicle 12 approach within their respective encounter zones 22 and 26. An encounter consists of a communication between vehicles 10 and 12, which may result in adjusting the heading of one or more of the vehicles, based on one of the strategies described herein. The encounter threshold will also provide a delay (in simulation cycles) to avoid re-encountering the same vehicles.

A first strategy, the north strategy, uses a preferred direction to establish a new heading. In this strategy, upon encounter each vehicle's heading is compared to a preferred direction heading (i.e., north or 90 degrees) which specifies the overall group's heading. The vehicle with the heading closest to the preferred direction is used as the new heading for the other vehicle.

By setting the overall group's heading to impact the individual's heading adjustment, the group should eventually advance in a sweeping motion in the direction of the overall group's heading. In addition, following is introduced at a small scale when two vehicles encounter and one adapts the heading of the other. This creates a short instance of following until the follower vehicle again adopts the random search scheme. Another net affect should be the consolidating of group members in the operational space or at least in clusters.

Figure 2:
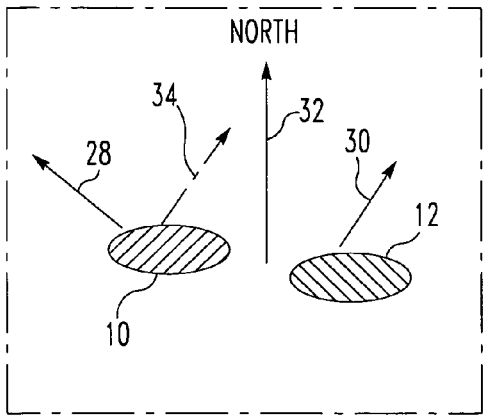
FIG. 2 is a schematic drawing illustrating a preferred embodiment of the method of the present invention, referred to hereafter as the north strategy.

Referring to FIG. 2, the north strategy is further illustrated. In this strategy, the first vehicle 10 has an initial heading 28, and the second vehicle 12 has an initial heading 30. A comparison of these initial headings 28 and 30 is made with the north or preferred direction 32. Since the second vehicle 12 has an initial heading 30 which is closer to the preferred direction 32 than the initial heading 28 of the first vehicle 10, the first vehicle 10 changes direction to new heading 34. The second vehicle 12 remains at its initial heading 30.

A variation on the north strategy involves switching the preferred direction when a preselected condition occurs. This preselected condition can be the elapse of a period of time, the finding of a predefined number of targets, or the occurrence of a set number of encounters with other vehicles. This will result in the overall group moving back to its point of origin. This strategy is a slight variation on the north strategy, which would allow a second pass over already explored area. This variation may compensate for targets that are missed and supports running multiple passes over the same area.

Another strategy, the best finder strategy, compares the number of targets found by each vehicle and uses the direction of the vehicle finding more targets. The heading of the vehicle with the most targets found is used as the heading for the other vehicles in the encounter. Based on observations from social animals, there are members in a group that show higher success at discovering food, and other members can be seen to mimic the actions of this best finder. This strategy allows the vehicle that has found the most targets to influence the heading of the second vehicle during an encounter. This could be interpreted as the best finder leading the second vehicle to a concentration of targets. This strategy should improve target finding when the targets have a clustered or patch distribution given successful exchange between the best finder and second vehicle.

Figure 3:
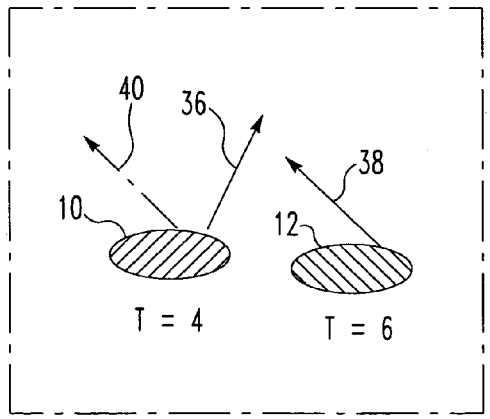
FIG. 3 is a schematic drawing illustrating another preferred embodiment of the present invention referred to hereafter as the best finder strategy.

Referring to FIG. 3, the best finder strategy is illustrated in which the vehicle with the most targets T found sets the heading for the second vehicle. For purposes of illustration, the first vehicle 10 has located four targets and the second vehicle 12 has located six targets. The first vehicle 10 has an initial heading 36 and the second vehicle 12 has an initial heading 38. The first vehicle 10 has a new heading 40 which conforms to the initial heading 38 of the second vehicle 12 since the second vehicle 12 has located more targets.

Yet another strategy is the best finder or north strategy. This strategy is a combination the north strategy and the best finder strategy such that if both vehicles have found no targets or have the same number of targets, the vehicles use the north strategy since no one vehicle has out performed the other. If there is a discrepancy in number of targets between the two vehicles, the vehicles use the best finder strategy.

Figure 4A:
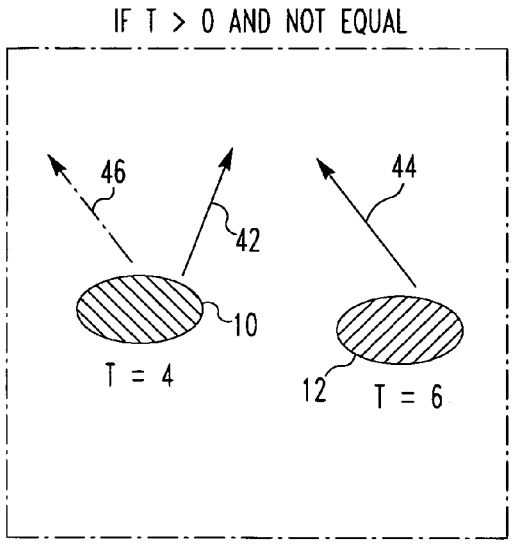
FIGS. 4*a* and 4*b* are schematic drawings illustrating another preferred embodiment of the present invention referred to hereafter as the best finder or north strategy.
Figure 4B:
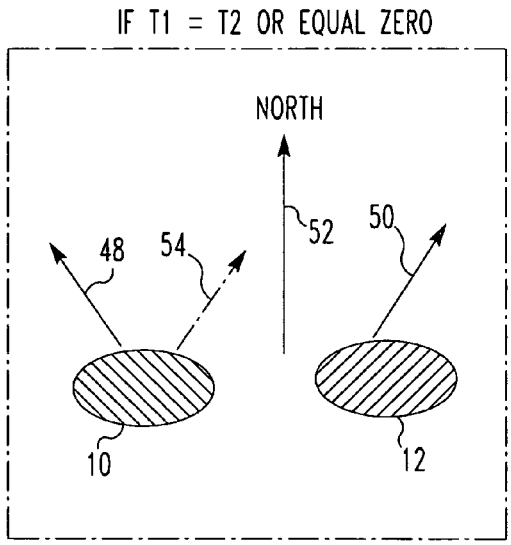

Referring to FIGS. 4*a* and 4*b*, the best finder or north strategy is illustrated. In FIG. 4*a* the first vehicle 10 has an initial heading 42 and the second vehicle 12 has an initial heading 44 under conditions where the first vehicle 10 has located four targets, T=4, and the second vehicle 12 has located six targets, T=6. Because the second vehicle 12 has located more targets, the first vehicle 10 assumes a new heading 46 that conforms to the initial heading 44 of the second vehicle 12. If both vehicles have located the same number of targets T, or if no targets have been located, FIG. 4*b* is applicable. In FIG. 4*b*, the first vehicle 10 has an initial heading 48 and the second vehicle 12 has an initial heading 50. Since the initial heading 50 of the second vehicle 12 is closer to the preferred direction or north 52, the first vehicle 10 will assume a new heading 54 which conforms to the initial heading of the second vehicle 12.

The best finder and north strategy is a variation of the best finder strategy. The variation consists of setting the best finder vehicle's heading to the preferred direction that in this case is north 60. The other vehicle receives the best finder's heading as its new heading. The motivation for this strategy is to introduce some degree of delegating one vehicle's actions to another. The vehicle with the most targets found will send the second vehicle in the same direction since targets have been found there to continue the local search. The vehicle with the most targets will continue the global search by heading in the preferred direction to locate other concentrations of targets.

Figure 5:
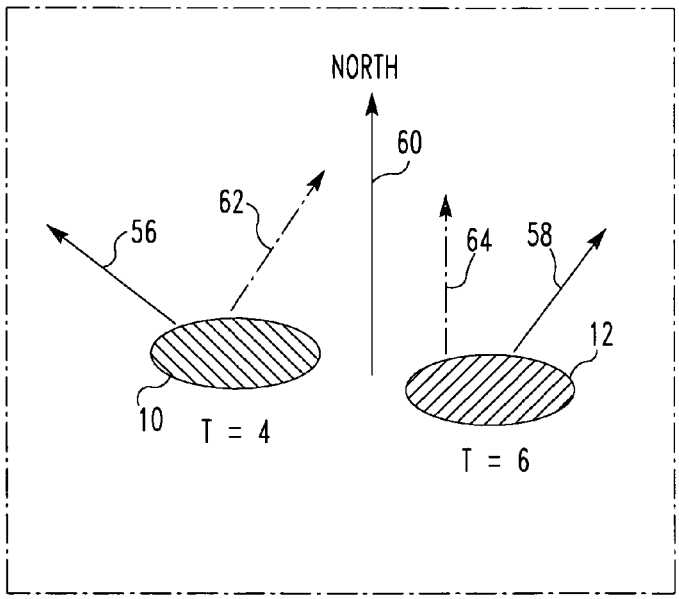
FIG. 5 is a schematic drawing illustrating still another preferred embodiment of the present invention referred to hereafter as the best finder and north strategy.

Referring to FIG. 5, the best finder and north strategy is illustrated in which the best finder strategy applies except as the best finder adjusts its heading to the overall group heading of north or the preferred direction. In this example, the first vehicle 10 has located four targets and the second vehicle 12 has located six targets. The first vehicle 10 has an initial heading 56 and the second vehicle 12 has an initial heading 58. Since the second vehicle 12 has located more targets T, it assumes a new heading 60 that is in a preferred direction or north 62. The first vehicle 10, which has located fewer targets T, assumes a new heading 64 in the same direction as the initial heading 58 of the second vehicle 12.

Another strategy concerns varying the vehicle's velocity based on the search outcome. The logic behind this strategy is that a vehicle should slow down and make a slow search if it finds a high ratio of targets to time searched. Otherwise, the vehicle should increase its velocity to advance to other areas more rapidly.

In order to perform this strategy, each vehicle is preprogrammed with an estimate, E, for the target density in the search area. This is weighted by a selected estimate weight, E_wt. Each vehicle has a value for experience, Exp, related to The number of targets found T, for an elapsed time, t, and weighted by E_wt, a weighting factor. Velocity, V, can then be changed in accordance with the following equations, where ΔV is the change in velocity:

$$\text{Exp} = \frac{T * \text{Exp_wt}}{t} \tag{1}$$

$$\Delta V = (E - \text{Exp}) * E_wt \tag{2}$$

Using these equations, it was observed that often the velocity, V, increases rapidly, and the vehicle exits the search area. Therefore, a maximum velocity can be set in the vehicle so that the velocity of the vehicle plus the change in velocity is set to the maximum if the maximum velocity would be exceeded. Likewise, a minimum velocity can be set if the change in velocity would bring the velocity below the minimum.

It will be appreciated by those skilled in the art that this velocity adjusting algorithm can be applied to any of the previous search strategies.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for searching an area for targets by a vehicle in conjunction with a plurality of other vehicles comprising the steps of:

dispersing by turning said vehicle in a random direction to establish a current heading and moving said vehicle at a current speed for a random distance;

detecting targets using sensors on said vehicle during said vehicle dispersing step to establish a number of detected targets;

aggregating by turning said vehicle in another random direction to establish another heading and moving said vehicle a random distance at a current speed;

detecting targets using sensors on said vehicle during said aggregating step;

detecting other vehicles using sensors on said vehicle during said aggregating step;

responding in a predesignated way to the detection of said other vehicle and continuing said movement during said aggregating step if one of said plurality of other vehicles is not detected; and repeating said dispersing and aggregating steps.

2. The method of claim 1 wherein said step of dispersing further comprises:

measuring an elapsed time; and calculating a new velocity from said current velocity, said number of detected targets and said elapsed time.

3. The method of claim 2 further comprising the steps of:

providing said vehicle and said plurality of vehicles with an estimate of the target density in the search area, an estimate weight and an experience weight;

said step of calculating a new velocity comprising:

calculating a value for experience based on the experience weight and the elapsed time; and calculating a new velocity from said experience value, the target density estimate and the estimate weight.

4. The method of claim 1 wherein the step of responding comprises:

transmitting said current heading to said detected other vehicle; and receiving an other vehicle current heading from said detected other vehicle.

5. The method of claim 4 further comprising the step of:

providing said vehicle and said plurality of vehicles with preprogrammed conditions prior to initial dispersing, said preferred direction being multiple preferred directions; and associating each said condition with one said preferred direction;

said step of responding further comprising:

establishing a current condition from said preprogrammed conditions;

comparing said current heading with said preferred direction associated with said current condition; and comparing said received other vehicle current heading with said preferred direction associated with said current condition; and altering said current heading to match said received other vehicle current heading if said received other vehicle current heading is closer to said preferred direction associated with said current condition.

6. The method of claim 5 wherein said steps of dispersing and aggregating further comprise:

measuring an elapsed time; and calculating a new velocity from said current velocity, said number of detected targets and said elapsed time.

7. The method of claim 6 further comprising the steps of:

providing said vehicle and said plurality of vehicles with an estimate of the target density in the search area, an estimate weight and an experience weight;

said step of calculating a new velocity comprising:

calculating a value for experience based on the experience weight and the elapsed time; and calculating a new velocity from said experience value, the target density estimate and the estimate weight.

8. The method of claim 4 further comprising the steps of:

transmitting said current number of detected targets to said detected other vehicle;

receiving an other vehicle number of detected targets form said detected other vehicle;

said step of responding further comprising:

comparing said current number of detected targets to said received other vehicle number of detected targets; and altering said current heading to match said received other vehicle current heading if said received other vehicle number of detected targets is greater than said current number of detected targets.

9. The method of claim 8 wherein said step of dispersing further comprises:

measuring an elapsed time; and calculating a new velocity from said current velocity, said number of detected targets and said elapsed time.

10. The method of claim 9 further comprising the steps of:

providing said vehicle and said plurality of vehicles with an estimate of the target density in the search area, an estimate weight and an experience weight;

said step of calculating a new velocity comprising:

calculating a value for experience based on the experience weight and the elapsed time; and calculating a new velocity from said experience value, the target density estimate and the estimate weight.

11. The method of claim 4 further comprising the step of:

providing said vehicle and said plurality of vehicles with a preferred direction prior to initial dispersal;

said step of responding further comprising:

comparing said current heading with said preferred direction; and altering said current heading to match said received other vehicle current heading if said received other vehicle current heading is closer to said preferred direction.

12. The method of claim 11 wherein said steps of dispersing and aggregating further comprise:

measuring an elapsed time; and calculating a new velocity from said current velocity, said number of detected targets and said elapsed time.

13. The method of claim 12 further comprising the steps of:

providing said vehicle and said plurality of vehicles with an estimate of the target density in the search area, an estimate weight and an experience weight;

said step of calculating a new velocity comprising:

calculating a value for experience based on the experience weight and the elapsed time; and calculating a new velocity form said experience value, the target density estimate and the estimate weight.

14. The method of claim 4 further comprising the steps of:

providing said vehicle and said plurality of vehicles with a preferred direction prior to initial dispersal;

transmitting said current number of detected targets to said detected other vehicle;

receiving an other vehicle number of detected targets from said detected other vehicle;

said step of responding further comprising:

comparing said current number of detected targets to said received other vehicle number of detected targets;

altering said current heading to match said received other vehicle current heading if said received other vehicle number of detected targets is greater than said current number of detected targets; and altering said current heading to match said received other vehicle current heading if said received other vehicle current heading is closer to said preferred direction and if said received other vehicle number of detected targets is the same as said current number of detected targets.

15. The method of claim 14 wherein said step of dispersing further comprises:

measuring an elapsed time; and calculating a new velocity from said current velocity, said number of detected targets and said elapsed time.

16. The method of claim 15 further comprising the steps of:

providing said vehicle and said plurality of vehicles with an estimate of the target density in the search area, an estimate weight and an experience weight;

said step of calculating a new velocity comprising:

calculating a value for experience based on the experience weight and the elapsed time; and calculating a new velocity from said experience value, the target density estimate and the estimate weight.

17. The method of claim 4 further comprising the steps of:

providing said vehicle and said plurality of vehicles with a preferred direction prior to initial dispersal;

transmitting said current number of detected targets to said detected other vehicle;

receiving an other vehicle number of detected targets from said detected other vehicle;

said step of responding further comprising:

comparing said current number of detected targets to said received other vehicle number of detected targets;

altering said current heading to match said received other vehicle current heading if said received other vehicle number of detected targets is greater than said current number of detected targets; and altering said current heading to match the preferred direction if said received other vehicle number of detected targets is less than said current number of detected targets.

18. The method of claim 17 wherein said step of dispersing further comprises:

measuring an elapsed time; and calculating a new velocity from said current velocity, said number of detected targets and said elapsed time.

19. The method of claim 18 further comprising the steps of:

providing said vehicle and said plurality of vehicles with an estimate of the target density in the search area, an estimate weight and an experience weight;

said step of calculating a new velocity comprising:

calculating a value for experience based on the experience weight and the elapsed time; and calculating a new velocity from said experience value, the target density estimate and the estimate weight.

* * * * *